US011618607B2

(12) United States Patent
Sloan, II

(10) Patent No.: US 11,618,607 B2
(45) Date of Patent: Apr. 4, 2023

(54) LEAK RESISTANT FEATURE FOR BLISS BOX

(71) Applicant: INTERNATIONAL PAPER COMPANY, Memphis, TN (US)

(72) Inventor: James William Sloan, II, Edgefield, SC (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 17/381,340

(22) Filed: Jul. 21, 2021

(65) Prior Publication Data

US 2021/0347522 A1 Nov. 11, 2021

Related U.S. Application Data

(63) Continuation of application No. 16/155,935, filed on Oct. 10, 2018, now abandoned.

(51) Int. Cl.

| | |
|---|---|
| ***B65D 5/32*** | (2006.01) |
| ***B65D 5/42*** | (2006.01) |
| ***B65D 5/66*** | (2006.01) |

(52) U.S. Cl.

CPC ..... *B65D 5/323* (2013.01); *B65D 5/4266* (2013.01); *B65D 5/4279* (2013.01); *B65D 5/6632* (2013.01)

(58) Field of Classification Search

CPC .... B65D 5/323; B65D 5/4279; B65D 5/4287; B65D 5/24–241

USPC ..... 229/122.32, 122.21–122.26, 186, 189, 229/187, 902–906

See application file for complete search history.

(56) References Cited

U.S. PATENT DOCUMENTS

| | | | | |
|---|---|---|---|---|
| 3,146,933 | A | 9/1964 | Moore | |
| 3,734,391 | A | 5/1973 | Manizza | |
| 3,910,483 | A * | 10/1975 | Ritter | B65D 5/4233 229/162.1 |
| 4,067,491 | A | 1/1978 | Leakey et al. | |
| 4,706,809 | A | 11/1987 | Halsell | |

(Continued)

FOREIGN PATENT DOCUMENTS

| | | | |
|---|---|---|---|
| EP | 3115310 | A1 * | 1/2017 |
| EP | 3115310 | B1 | 9/2017 |

(Continued)

*Primary Examiner* — Nathan J Newhouse
*Assistant Examiner* — Phillip D Schmidt
(74) *Attorney, Agent, or Firm* — Michael J. Folkerts; Thomas W. Ryan

(57) ABSTRACT

A leak resistant bliss-type container comprising a first blank defining a bottom wall, opposed first side walls hingedly connected to longitudinal edges of the bottom wall and extending upwardly from the bottom wall, a vertical side flange hingedly connected to each of a pair of opposing lateral edges of the first side walls, and opposing bottom flanges hingedly connected to lateral edges of the bottom wall and extending upwardly in overlapping relation to the vertical side flanges. Second and third identical end blanks are provided, each end blank defining at least an end wall secured in overlapping relation to the vertical side flanges. A corner piece is defined by a web of material, each corner piece extending between a longitudinal edge of one of the vertical side flanges and a longitudinal edge of the bottom flange to define a leak resistant corner.

17 Claims, 7 Drawing Sheets

(56) References Cited

U.S. PATENT DOCUMENTS

| | | | | | |
|---|---|---|---|---|---|
| 4,711,390 | A | * | 12/1987 | Andrews | B30B 9/3032 229/125 |
| 4,832,257 | A | | 5/1989 | Wood | |
| 4,948,033 | A | | 8/1990 | Halsell, II et al. | |
| 5,372,299 | A | * | 12/1994 | Edgerton, Jr. | B65D 5/48016 206/427 |
| 5,967,406 | A | * | 10/1999 | Moorman | B65D 5/324 206/427 |
| 6,719,191 | B1 | | 4/2004 | Christensen et al. | |
| 8,011,565 | B2 | | 9/2011 | Churvis et al. | |
| 8,408,452 | B2 | | 4/2013 | Churvis et al. | |
| 9,061,791 | B2 | | 6/2015 | Cameron | |
| 9,061,792 | B2 | | 6/2015 | Smith | |
| 2007/0080200 | A1 | * | 4/2007 | Hamblin | A21B 3/131 229/177 |
| 2009/0078750 | A1 | | 3/2009 | Sheffield et al. | |
| 2013/0026059 | A1 | | 1/2013 | Jenkins | |
| 2015/0041481 | A1 | * | 2/2015 | Dean | B65D 5/323 220/826 |
| 2017/0166372 | A1 | | 6/2017 | Bugas | |
| 2020/0031517 | A1 | * | 1/2020 | Bugas | B65D 5/563 |

FOREIGN PATENT DOCUMENTS

| | | | |
|---|---|---|---|
| WO | WO2008060516 | A1 | 5/2008 |
| WO | WO2009032068 | A1 | 3/2009 |

* cited by examiner

LEAK RESISTANT FEATURE FOR BLISS BOX

RELATED APPLICATION

This application is a continuation application of prior U.S. patent application Ser. No. 16/155,935, filed Oct. 10, 2018, entitled "LEAK RESISTANT FEATURE FOR BLISS BOX," which is herein incorporated by reference in its entirety.

FIELD OF THE INVENTION

This invention relates generally to packaging and, more particularly, to a bliss-type container that reduces or limits fluid leakage from the container.

BACKGROUND OF THE INVENTION

Various styles of shipping containers are known in the prior art, including the so-called bliss-type container in which a wrapper is folded around and stapled or glued to a pair of end pieces to form an enclosed container. The end pieces normally comprise flat panels that form the end walls in the container, and the wrapper forms the bottom wall, sidewalls and top wall. Flanges on opposite edges of the wrapper are folded and glued or otherwise fastened to the end wall panels to secure the wrapper and end pieces together. The flanges fastened against the end wall panels in the corners of the container serve to strengthen the container in comparison to a typical box that is folded from a single blank and has single panel thickness in the end walls and sidewalls.

There is currently a need for a container that can provide the advantages of a bliss-type container while effectively limiting leakage of liquid that may be present in the container. In a particular application of a package utilizing a bliss-type container, the product may be a fresh or frozen poultry product. The poultry product used in this package is typically bagged, but may not always be sealed and this can allow fluid to run out of the bags, and out of seams at the lower portions of the box. If there is any fluid leakage from the product, there can be contamination issues in relation to adjacent containers. For example, when cross stacking containers, such as cross stacking poultry packages with packages containing foods that a consumer may consume without washing, e.g., vegetables, fruits, etc., fluids may leak from a conventional bliss-type container with the possibility of contacting and contaminating food in other containers. While bliss-type containers are being used heavily by food distributors, food distributors are increasingly rejecting boxes from poultry suppliers if the container exhibits any signs of leakage, such that it is highly desirable to have a stackable leak resistant package.

SUMMARY OF THE INVENTION

In accordance with an aspect of the invention, a leak resistant bliss-type container is provided comprising a first blank defining a bottom wall, opposed first side walls hingedly connected to longitudinal edges of the bottom wall and extending upwardly from the bottom wall, a vertical side flange hingedly connected to each of a pair of opposing lateral edges of the first side walls, and opposing bottom flanges hingedly connected to lateral edges of the bottom wall and extending upwardly in overlapping relation to the vertical side flanges. Second and third identical end blanks are provided, each end blank defining at least an end wall secured in overlapping relation to the vertical side flanges. A corner piece is defined by a web of material, each corner piece extending between a longitudinal edge of one of the vertical side flanges and a longitudinal edge of the bottom flange to define a leak resistant corner.

Each vertical side flange may be separated from an adjacent bottom flange on the first blank by a flange cut extending from a lateral edge of the first blank toward a respective lateral edge of the bottom wall, and the web of material defining each corner piece may extend laterally from a lateral edge of the bottom wall to a terminal end of the flange cut spaced from the lateral edge of the bottom wall.

A lateral dimension of each corner piece, extending on the first blank from a lateral edge of the bottom wall to the terminal end of the flange cut, may be generally equal to a dimension extending across the flange cut between the longitudinal edges of a bottom flange and a longitudinal edge of an adjacent vertical side flange.

A fold line may be provided extending diagonally across each corner piece to define first and second generally triangular corner piece halves, and the first blank may be formed of a corrugated paperboard material having internal flutes, wherein flutes in at least one of the corner piece halves extend in a vertical direction.

Hinge connections for the opposed first side walls may be defined on the first blank by respective longitudinal fold lines, and the longitudinal edges of the bottom flanges may be displaced longitudinally inwardly from respective adjacent longitudinal fold lines.

The longitudinal edges of the vertical side flanges may be generally aligned with the respective longitudinal fold lines.

Hinge connections for the opposed first side walls may be defined on the first blank by respective longitudinal fold lines, and the longitudinal edges of the vertical side flanges may be displaced longitudinally outward from respective adjacent longitudinal fold lines.

The longitudinal edges of the bottom flanges may be generally aligned with the respective longitudinal fold lines.

The first blank may comprise corrugated cardboard and flutes in the corner pieces and in the vertical side flanges may extend vertically, and the vertical side flanges may extend from the bottom wall to upper edges of the first side walls.

The first blank may comprise corrugated cardboard and flutes in the corner pieces and in the vertical side flanges may extend vertically, and the vertical side flanges may extend from a location spaced above the bottom wall to upper edges of the first side walls.

Each end blank may include a pair of intermediate walls hingedly connected to opposing longitudinal edges of the end wall and partial side walls hingedly connected to the intermediate walls and secured to respective inner surfaces of the first side walls.

Each bottom flange may be secured to outer surfaces of an adjacent pair of vertical side flanges.

In accordance with another aspect of the invention, a leak resistant bliss-type container is provided comprising a first blank defining a bottom wall, opposed first side walls hingedly connected to longitudinal edges of the bottom wall and extending upwardly from the bottom wall, a vertical side flange hingedly connected to each of a pair of opposing lateral edges of the first side walls, and opposing bottom flanges hingedly connected to lateral edges of the bottom wall and extending upwardly and secured to outer surfaces of adjacent pairs of the vertical side flanges. Second and third identical end blanks are provided, each end blank defining at least an end wall secured in overlapping relation to the vertical side flanges. A corner piece is defined by a folded web of material pinched between a bottom flange and an adjacent vertical side flange to define a leak resistant corner.

The corner piece may be integrally formed with the bottom flange and the adjacent vertical side flange.

The corner piece may be formed of longitudinal end portions of the bottom flange and may comprise triangular halves pivoted into overlapping relationship.

In accordance with a further aspect of the invention, a blank construction is provided for a leak resistant bliss-type container comprising first, second, and third blanks securable together. The first blank comprises a central bottom wall having opposing longitudinal edges and opposing lateral edges. A first side wall is hingedly connected to each of the longitudinal edges of the bottom wall at a respective longitudinal fold line, and each first side wall includes an inner surface and opposing lateral edges. A bottom flange is hingedly connected to each of the opposing lateral edges of the bottom wall at respective bottom flange fold lines. A vertical side flange is hingedly connected to each lateral edge of the first side walls at respective side flange fold lines for overlapping relationship with an adjacent bottom flange. Each vertical side flange is separated from the adjacent bottom flange by a flange cut extending laterally from a lateral edge of the first blank and each vertical side flange is securable to a respective adjacent bottom flange. Each of the second and third blanks comprises an end wall having opposing longitudinal edges, and partial side walls hingedly connected to the end wall at opposing longitudinal outer ends of the second and third blanks. Each partial side wall is securable to the inner surfaces of the first side walls. A corner piece extends laterally into each flange cut, each corner piece extending from a location adjacent to a bottom wall lateral edge toward a respective lateral edge of the first blank to define leak resistant corners when the bottom flanges and vertical side flanges are pivoted into overlapping relationship.

The construction may further include an intermediate wall hingedly connected between each of the partial side walls and one of the longitudinal edges of the end wall.

Each corner piece may comprise a rectangular web of material extending between each longitudinal edge of a bottom flange and a longitudinal edge of an adjacent vertical side flange.

The web of material may be foldable about a diagonal fold line and may be pinched between a bottom flange and an adjacent vertical side flange to define a leak resistant corner when the bottom flange is pivoted into overlapping relationship over the adjacent vertical side flange.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
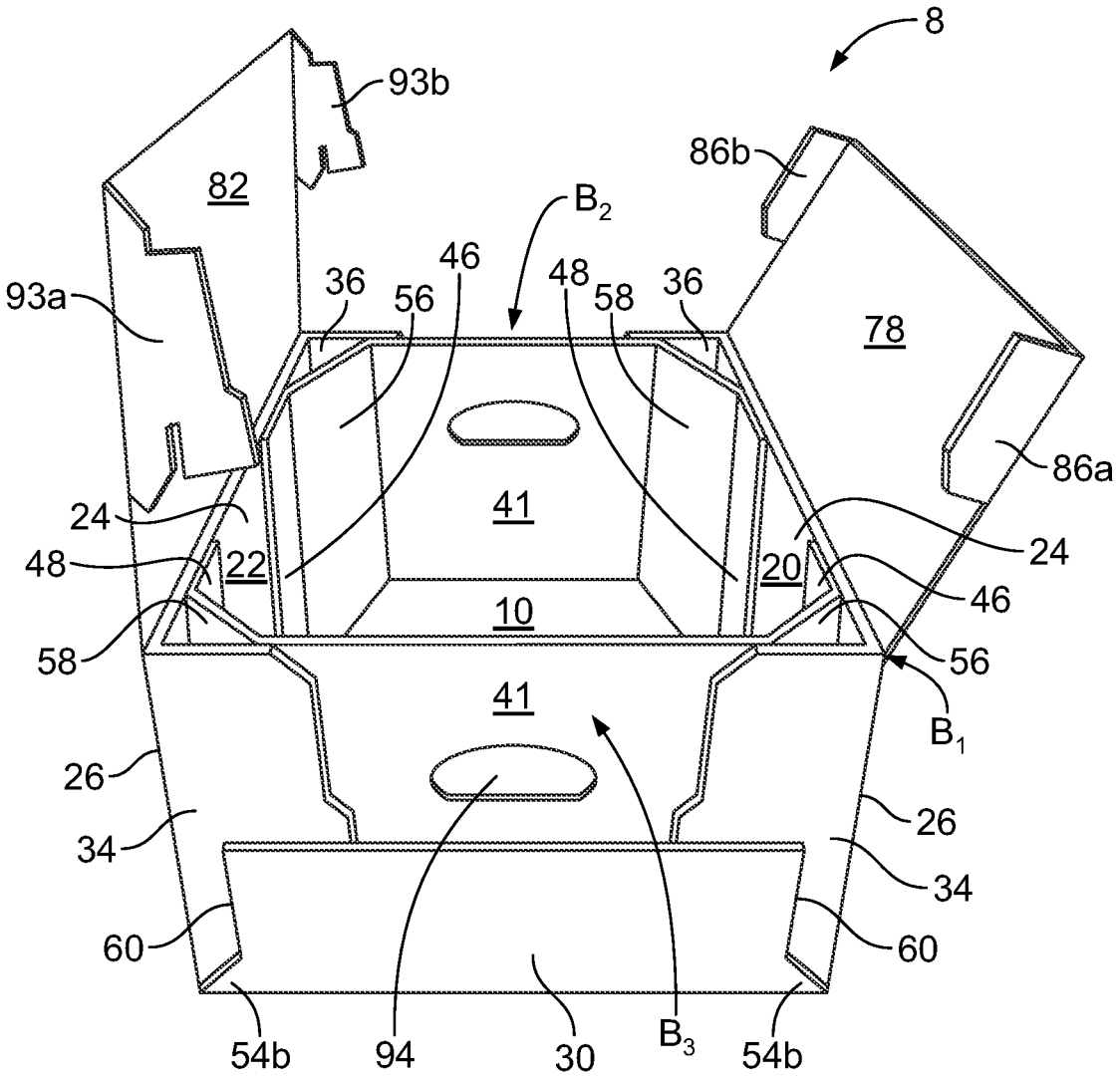
FIG. 1 is a perspective view of a bliss-type container constructed in accordance with the present description.

Referring to FIG. 1, the present description is directed to a bliss-type container 8 that is configured to include one or more features for resisting passage or leakage of fluids from an interior region of the container and that can substantially avoid a decrease in compression strength to resist distortion of vertical container walls, such as when containers are stacked on top of each other. The bliss-type container 8 generally includes a main body wrapper defined by a first blank $B_1$ and two bliss end pieces defined by second and third identical end blanks $B_2$, $B_3$ that can be secured to opposed ends of the main body wrapper.

Figure 2:
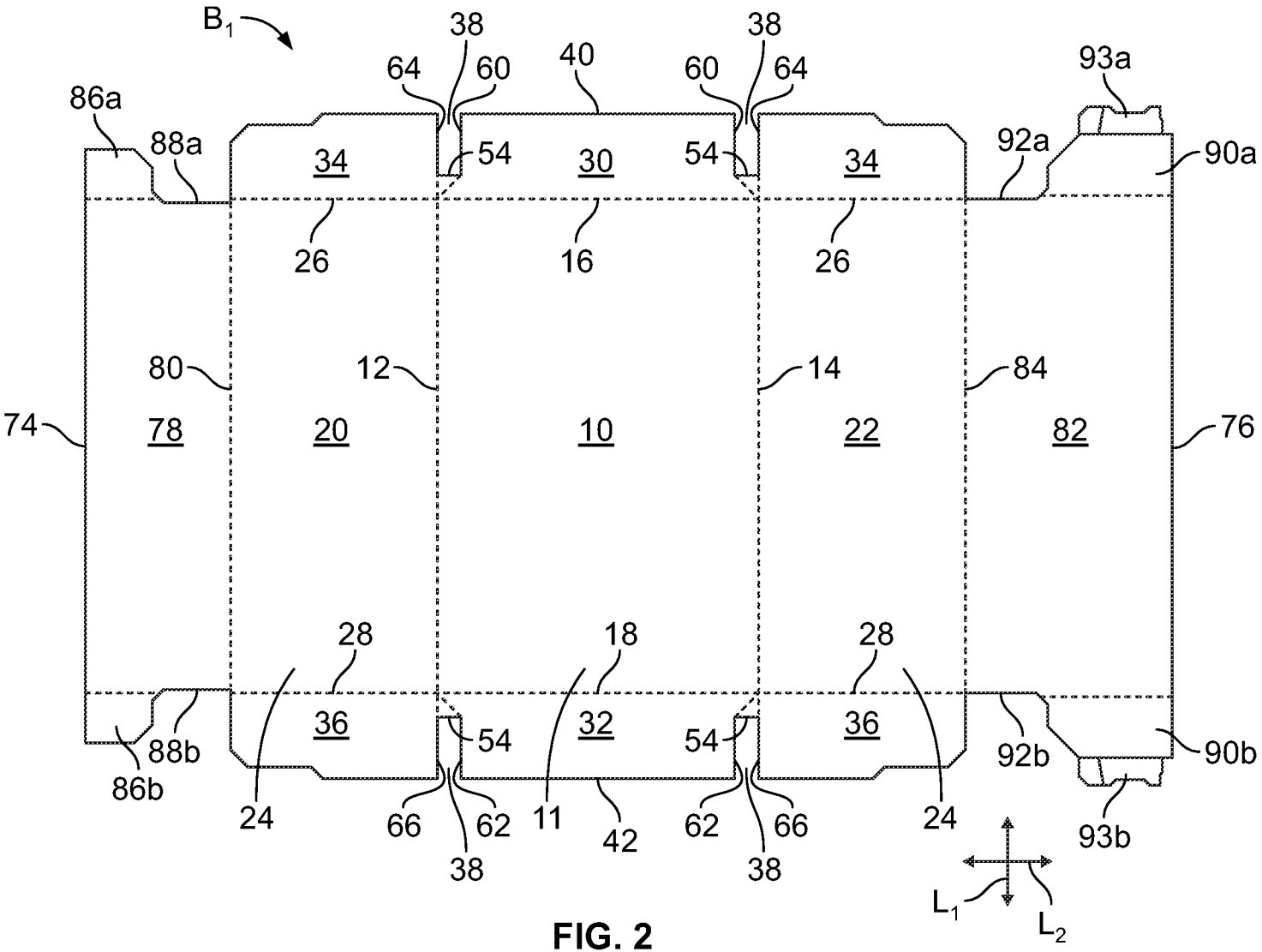
FIG. 2 is a plan view of a blank comprising a main body wrapper for the bliss-type container.

Referring to FIG. 2, the first blank $B_1$ may be formed of a corrugated cardboard material and may be die cut to the shape shown herein, although other materials and variations of the illustrated shape may be provided within the scope of the bliss-type container described and claimed herein. The blank $B_1$ illustrated in FIG. 2 is a planar piece of material in which an inner side 11 is shown facing out of the page. The blank $B_1$ extends in a lateral direction $L_1$ between first and second lateral edges, generally designated 40 and 42, respectively, and further extends in a longitudinal direction $L_2$ between first and second longitudinal edges, generally designated 74 and 76, respectively.

The first blank $B_1$ comprises a central bottom wall 10 having opposing longitudinal edges 12, 14 and opposing lateral edges 16, 18. A pair of first side walls 20, 22 are hingedly connected to the bottom wall 10 along respective fold lines defined at the longitudinal edges 12, 14, and each first side wall 20, 22 includes an inner surface 24 and opposing lateral edges 26, 28. Bottom flanges 30, 32 are hingedly connected to the bottom wall 10 along respective fold lines defined at the opposing lateral edges 16, 18 of the bottom wall 10.

A pair of vertical side flanges 34 and 36 are hingedly connected to each of the side walls 20, 22 along fold lines defined at the lateral edges 26 and 28, respectively, of the first side walls 20, 22. The vertical side flanges 34 are located on either side of the bottom flange 30 and are separated from the bottom flange 30 by a flange cut 38 defined between adjacent longitudinal edges 60, 64 of the bottom flange 30 and vertical side flange 34, respectively, wherein the flange cut 38 extends laterally from the lateral edge 40 of the blank $B_1$ toward the lateral edge 16 of the bottom wall 10. The vertical side flanges 36 are located on either side of the bottom flange 32 and are separated from the bottom flange 32 by a flange cut 38 defined between adjacent longitudinal edges 62, 66 of the bottom flange 32 and vertical side flange 36, respectively, wherein the flange cut 38 extends laterally from the lateral edge 42 of the blank $B_1$ toward the lateral edge 18 of the bottom wall 10. The bottom flange 30 and the vertical side flanges 34 are configured to overlap and be secured together, and the bottom flange 32 and the vertical side flanges 36 are configured to overlap and be secured together, as is described further below for the container construction.

A first top wall panel 78 is hingedly attached to the first side wall 20 along a fold line defined at an outer longitudinal edge 80 of first the side wall 20, and defines the first longitudinal edge 74. A second top wall panel 82 is hingedly attached to the other first side wall 22 along a fold line defined at an outer longitudinal edge 84 of first the side wall 22, and defines the second longitudinal edge 76. A first pair of closure flaps 86*a*, 86*b* are hingedly attached to opposing lateral edges 88*a*, 88*b* of the first top wall panel 78. A second pair of closure flaps 90*a*, 90*b* are hingedly attached to opposing lateral edges 92*a*, 92*b* of the second top wall panel 78, and include respective distal fold lock portions 93*a*, 93*b*.

Figure 3:
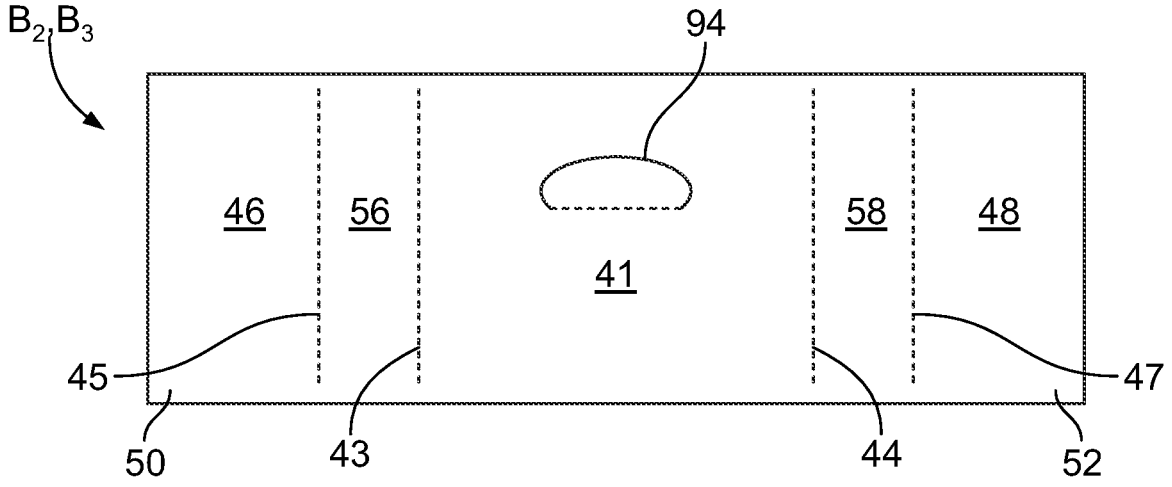
FIG. 3 is a plan view of a blank for forming an exemplary bliss end of the bliss-type container.

Referring to FIG. 3, the second and third end blanks $B_2$, $B_3$ form bliss ends of the container 8 and are illustrated herein formed as a planar piece of material, and may be formed of a corrugated cardboard material cut to the shape shown, although other materials and variations of the illustrated shape may be provided within the scope of the bliss-type container described and claimed herein. Each of the end blanks $B_2$, $B_3$ include an end wall 41 having opposing longitudinal edges 43, 44. Intermediate walls 56, 58 are hingedly connected to the end wall 41 at the respective longitudinal edges 43, 44 and partial side walls 46, 48 are hingedly connected to longitudinal edges 45, 47 of the intermediate walls 56, 58, such that the intermediate walls 56, 58 define a hinge connection between the end wall 41 and longitudinal outer ends 50, 52 of the second and third blanks $B_2$, $B_3$ defined by the partial side walls 46, 48, respectively.

In a construction of the container 8 illustrated in FIG. 1, the first side walls 20, 22 of the first blank $B_1$ can be pivoted vertical to the bottom wall 10, and the end walls 41 of the end blanks $B_2$, $B_3$ can be positioned adjacent to the lateral edges 16, 18 of the bottom wall 10. The partial side walls 46, 48 of the end blanks $B_2$, $B_3$ can be secured, such as by adhesive connections, to adjacent inner surfaces 24 of the first side walls 20, 22, and the vertical flanges 34, 36 can be pivoted perpendicular to the first side walls 20, 22 and may be adhesively secured to the adjacent end walls 41. Although adhesive connections are described herein as an exemplary means of forming a connection between panels in the present containers, it may be understood that other methods of connecting adjacent panels may be implemented including, without limitation, staples or equivalent fastening means.

It should be understood that the bliss end construction formed by the end blanks $B_2$, $B_3$ is not limited to the configuration shown herein and may encompass any bliss end. For example, and without limitation, the bliss ends of the container 8 may comprise only the end wall 41 secured in overlapping relation to the vertical side flanges 34, 36. Alternatively, the partial side walls 46, 48 can be hingedly connected directly to the longitudinal edges 43, 44 of the end wall 41 and secured to the adjacent first side walls 20, 22.

Figure 4:
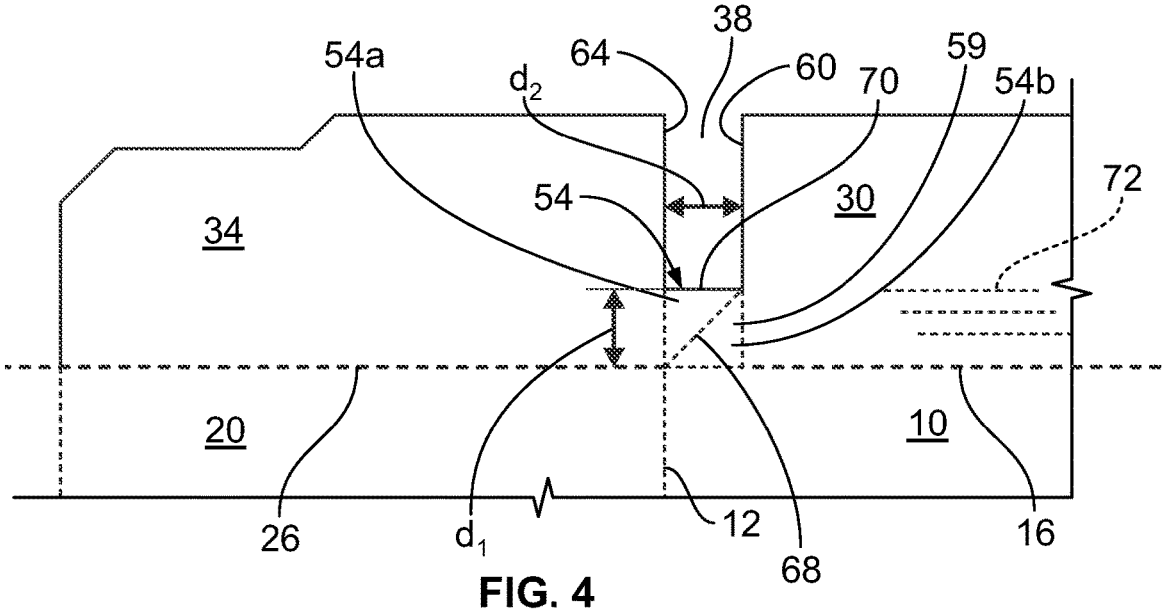
FIG. 4 is an enlarged view of a corner piece illustrated in FIG. 2 for forming a leak resistant corner.

FIG. 4 illustrates the flange cut 38 between the bottom flange 30 and an adjacent vertical side flange 34, which is typical of each of the four flange cuts 38 on the first blank $B_1$. A corner piece 54 extends laterally into the flange cut 38 from a location adjacent to the bottom wall lateral edge 16 toward the lateral edge 40 of the first blank $B_1$. The corner piece 54 comprises a rectangular web of material 59 extending between the longitudinal edge 60 of the bottom flange 30 and the adjacent longitudinal edge 64 of the vertical side flange 34 and defines a terminal end of the flange cut 38, i.e., at an edge 70 of the corner piece 54, spaced laterally from the lateral edge 16 of the bottom wall 10. A lateral dimension $d_1$ of the corner piece 54, extending from the lateral edge 16 of the bottom wall 10 to the terminal end 70 of the flange cut 38, is generally equal to a longitudinal dimension $d_2$ of the corner piece 54 extending across the flange cut 38 between the adjacent longitudinal edges 60, 64 of the bottom flange 30 and the vertical side flange 34. A fold line 68 extends diagonally across the corner piece 54 to define first and second generally triangular corner piece halves 54*a*, 54*b*. The corrugated paperboard material forming the first blank $B_1$ includes internal flutes 72, illustrated herein extending in an exemplary direction parallel to the longitudinal direction $L_2$, see FIG. 1, wherein flutes 72 in at least one of the corner piece halves 54*a*, 54*b* extend in a vertical direction when the bottom flange 30 is pivoted perpendicular to the first side wall 20 on the constructed container 8, as is described further below.

It may be understood that the corner pieces 54 described with reference to FIG. 4 are formed from a portion of the bottom flanges 30, 32, wherein the longitudinal edges 60, 62 of the bottom flanges 30, 32 extending along the flange cuts 38 are displaced longitudinally inwardly, i.e., toward the longitudinal center of the bottom flanges 30, 32, from longitudinal alignment with respective adjacent longitudinal edges 12, 14 of the bottom wall 10. Further, the longitudinal edges 64, 66 of the vertical side flanges 34, 36 are generally aligned with the respective longitudinal edges 12, 14 of the bottom wall 10.

Figure 5:
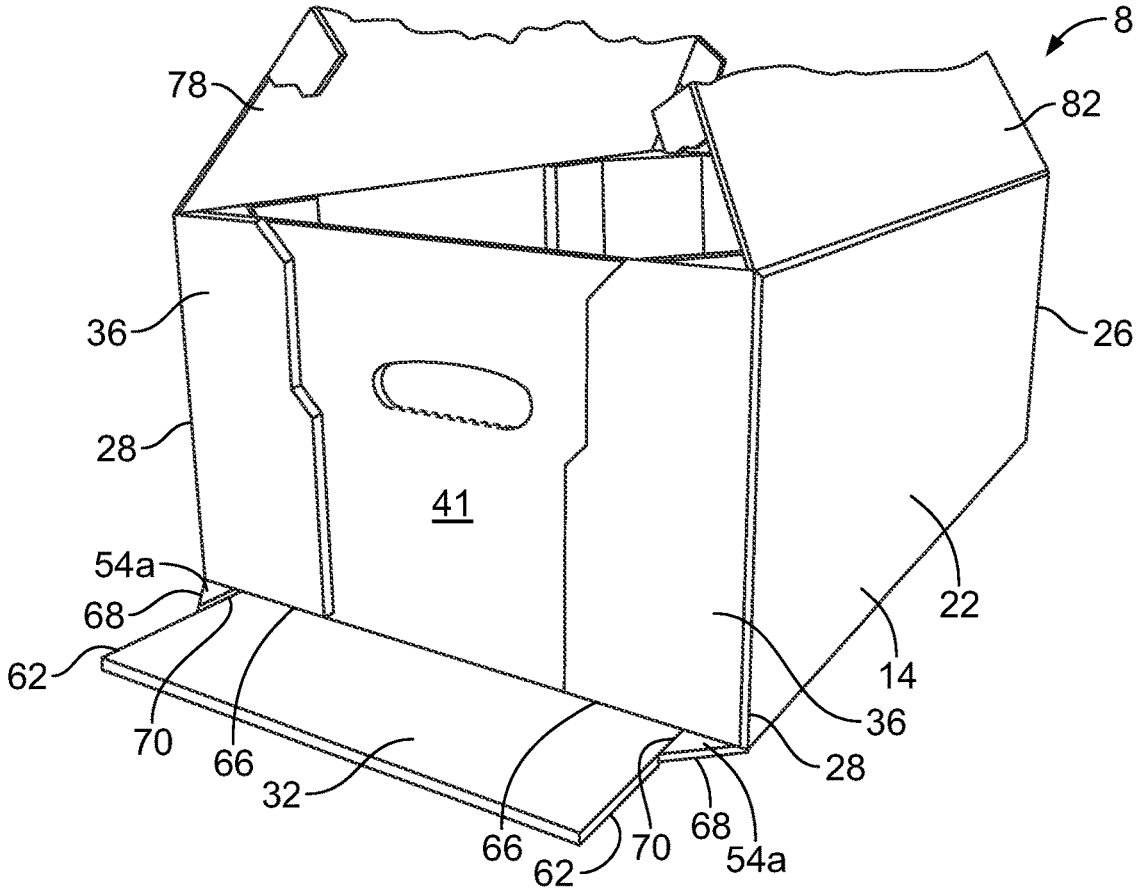
FIG. 5 is a perspective view illustrating an intermediate step in forming the bliss-type container with vertical side flanges folded inward.
Figure 6:
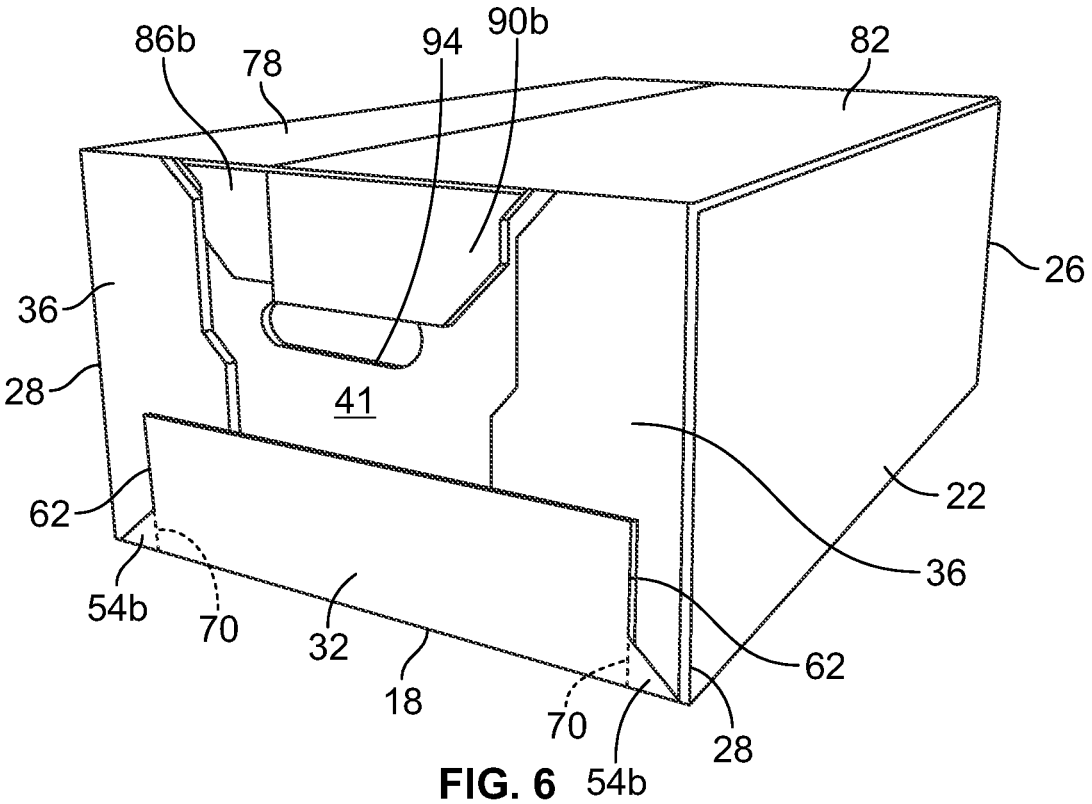
FIG. 6 is a perspective view of the bliss-type container of FIG. 1 with the top wall panels closed.

In the construction of the container 8, pivoting of the vertical side flanges 34, 36 toward the position perpendicular to the first side walls 20, 22 pivots the corner piece half 54*a* about the fold line 68 to a position overlapping the second corner piece half 54*b*, as is illustrated in FIG. 5. It may be understood that the flutes 72 in the corner piece half 54*a* have a direction of elongation extending parallel to the bottom wall longitudinal edges 12, 14, such that upward pivoting of the bottom flanges 30, 32 to the position overlapping the vertical side flanges 34, 36, as illustrated in FIG. 6, positions the flutes 72 in the corner piece half 54*a* in a vertical orientation. The bottom flanges 30, 32 may be secured, e.g., secured with adhesive, to the vertical side flanges 34, 36 to provide a configuration of the container 8 for receiving a product therein. It may be understood that in the secured position of the bottom flanges 30, 32, the longitudinal edges 60, 62 are horizontally spaced from the lateral edges 26, 28 of the side walls 20, 22, and the corner piece halves 54*a*, 54*b* form leak resistant connecting portions extending between the longitudinal edges 60, 62 and the lower corners of the container 8, see FIGS. 1 and 6.

It should also be understood that pivoting of the bottom flanges 30, 32 into overlapping relationship with the vertical side flanges 34, 36 pinches the corner piece halves 54*a* between the vertical side flanges 34, 36 and the bottom flanges 30, 32, i.e., at the corner piece half 54*b*, to form leak resistant joints at each of the four lower corners of the container 8 that can prevent or resist outward passage of fluids that may have passed through the bliss end, i.e., between the connection of the end blanks $B_2$, $B_3$ to the main body wrapper $B_1$. The vertical orientation of the flutes 72 extending parallel to the cut edge defining the terminal end 70 in the corner piece half 54*a* comprises an orientation that avoids outward passage of fluids along or through the flutes 72 at the container corners. Additionally, by forming the leak resistant corner pieces 54 from a portion of the bottom flanges 30, 32, the vertical side flanges 34, 36 remain unaltered and can extend from supporting engagement against the bottom wall 10 to the upper edges of the first side walls 20, 22 and the end walls 41, see FIG. 5, to substantially minimize a reduction in vertical compression strength at the ends of the container 8. That is, in a construction including flutes 72 extending vertically, i.e., parallel to the lateral edges 26, 28, the vertical side flanges 34, 36 can provide a continuous vertical support structure extending from the bottom wall 10 to the upper edge of the container 8.

The assembly of the container 8 may be performed on a conventional forming machine for constructing bliss-type containers. Alternatively, the container 8 may be constructed manually.

Following placement of a product in the container 8, the top wall panels 78, 82 may be pivoted to close the top of the container 8. The first pair of closure flaps 86*a*, 86*b* can be pivoted down, and the second pair of closure flaps 90*a*, 90*b* can be pivoted into partial overlapping relation over the first pair of closure flaps 86*a*, 86*b*, and distal fold lock portions 93*a*, 93*b* can be folded into hand holes 94 formed in the end walls 41, fastening the top wall panels 78, 82 in a closed position.

Figure 8:
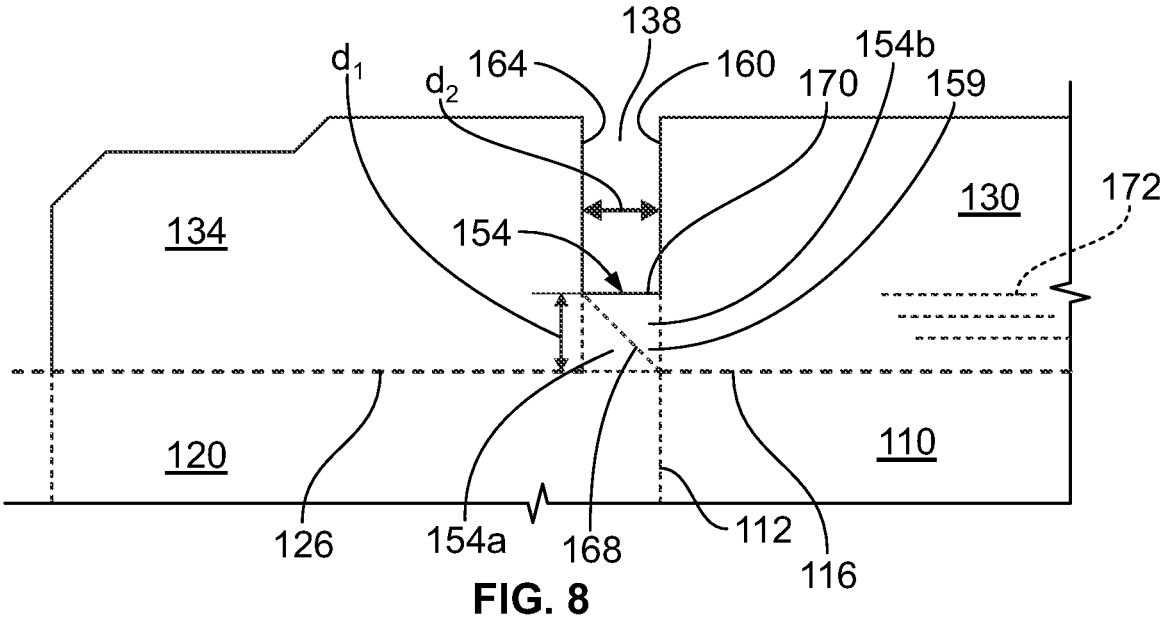
FIG. 8 is an enlarged view of a corner piece illustrated in FIG. 7 for forming a leak resistant corner.
Figure 7:
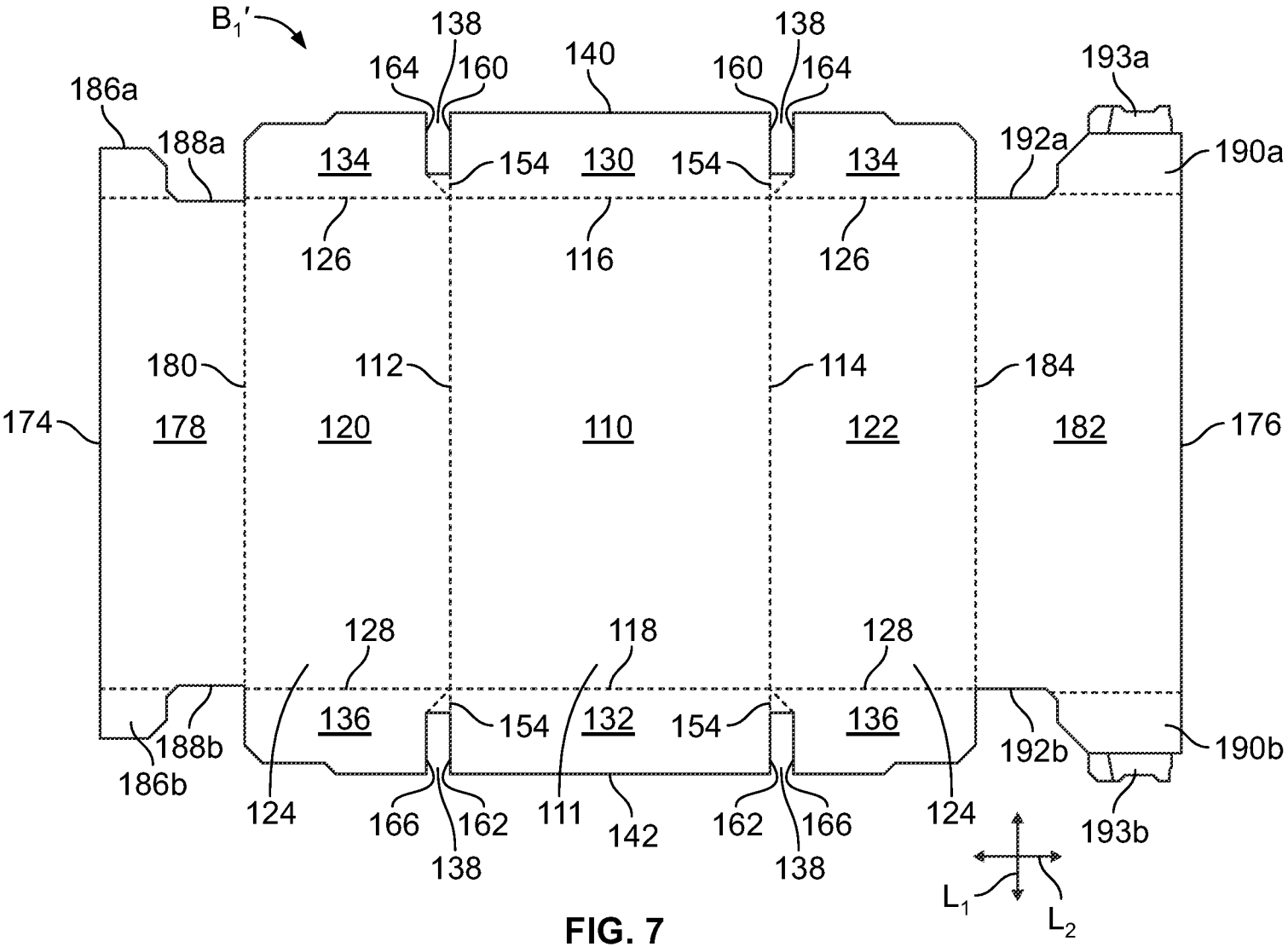
FIG. 7 is a plan view of a blank comprising a main body wrapper for the bliss-type container and illustrating a second configuration of a corner piece for forming a leak resistant corner.
Figure 9:
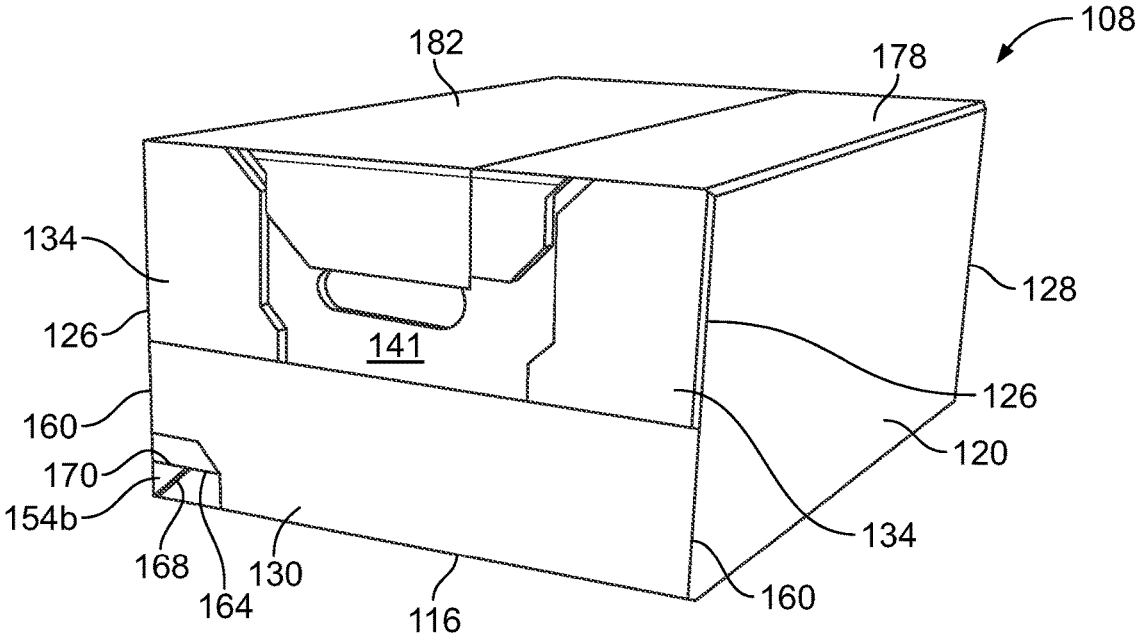
FIG. 9 is a perspective view of a bliss-type container constructed using the main body wrapper of FIG. 7.

Referring to FIGS. 7-9, an alternative configuration of the bliss-type container is described wherein elements corresponding to similar elements in the configuration of FIGS. 1-6 are identified with the same reference numeral increased by 100. In the container 108 of FIGS. 7-9, a variation of the main wrapper blank $B_1$' is described, wherein second and third end pieces for the bliss-type container 108 can be identical to the end blanks $B_2$, $B_3$ described above with reference to FIG. 3, or could comprise any other bliss end construction.

Referring to FIG. 7, the first blank $B_1$' may be formed of a corrugated cardboard material and may be die cut to the shape shown herein, although other materials and variations of the illustrated shape may be provided within the scope of the bliss-type container described and claimed herein. The blank $B_1$' illustrated in FIG. 7 is a planar piece of material in which an inner side 111 is shown facing out of the page. The blank $B_1$' extends in a lateral direction $L_1$ between first and second lateral edges, generally designated 140 and 142, respectively, and further extends in a longitudinal direction $L_2$ between first and second longitudinal edges, generally designated 174 and 176, respectively.

The first blank $B_1$' comprises a central bottom wall 110 having opposing longitudinal edges 112, 114 and opposing lateral edges 116, 118. A pair of first side walls 120, 122 are hingedly connected to the bottom wall 110 along respective fold lines defined at the longitudinal edges 112, 114, and each first side wall 120, 122 includes an inner surface 124 and opposing lateral edges 126, 128. Bottom flanges 130, 132 are hingedly connected to the bottom wall 110 along respective fold lines defined at the opposing lateral edges 116, 118 of the bottom wall 110.

A pair of vertical side flanges 134 and 136 are hingedly connected to each of the side walls 120, 122 along fold lines defined at the lateral edges 126 and 128, respectively, of the first side walls 120, 122. The vertical side flanges 134 are located on either side of the bottom flange 130 and are separated from the bottom flange 130 by a flange cut 138 defined between adjacent longitudinal edges 160, 164 of the bottom flange 130 and vertical side flange 134, respectively, wherein the flange cut 138 extends laterally from the lateral edge 140 of the blank $B_1$' toward the lateral edge 116 of the bottom wall 110. The vertical side flanges 136 are located on either side of the bottom flange 132 and are separated from the bottom flange 132 by a flange cut 138 defined between adjacent longitudinal edges 162, 166 of the bottom flange 132 and vertical side flange 136, respectively, wherein the flange cut 138 extends laterally from the lateral edge 142 of the blank $B_1$' toward the lateral edge 118 of the bottom wall 110. The bottom flange 130 and the vertical side flanges 134 are configured to overlap and be secured together, and the bottom flange 132 and the vertical side flanges 136 are configured to overlap and be secured together, as is described further below for the container construction.

A first top wall panel 178 is hingedly attached to the first side wall 120 along a fold line defined at an outer longitudinal edge 180 of the first side wall 120, and defines the first longitudinal edge 174. A second top wall panel 182 is hingedly attached to the other first side wall 122 along a fold line defined at an outer longitudinal edge 184 of the first side wall 122, and defines the second longitudinal edge 176. A first pair of closure flaps 186*a*, 186*b* are hingedly attached to opposing lateral edges 188*a*, 188*b* of the first top wall panel 178. A second pair of closure flaps 190*a*, 190*b* are hingedly attached to opposing lateral edges 192*a*, 192*b* of the second top wall panel 178, and include respective distal fold lock portions 193*a*, 193*b*.

FIG. 8 illustrates the flange cut 138 between the bottom flange 130 and an adjacent vertical side flange 134, which is typical of each of the four flange cuts 138 on the first blank $B_1$'. A corner piece 154 extends laterally into the flange cut 138 from a location adjacent to the bottom wall lateral edge 116 toward the lateral edge 140 of the first blank $B_1$'. The corner piece 154 comprises a rectangular web of material 159 extending between the longitudinal edge 160 of the bottom flange 130 and the adjacent longitudinal edge 164 of the vertical side flange 134 and defines a terminal end of the flange cut 138, i.e., at an edge 170 of the corner piece 154, spaced laterally from the lateral edge 116 of the bottom wall 110. A lateral dimension $d_1$ of the corner piece 154, extending from the lateral edge 116 of the bottom wall 110 to the terminal end 170 of the flange cut 138, is generally equal to a longitudinal dimension $d_2$ of the corner piece 154 extending across the flange cut 138 between the adjacent longitudinal edges 160, 164 of the bottom flange 130 and the vertical side flange 134. A fold line 168 extends diagonally across the corner piece 154 to define first and second generally triangular corner piece halves 154*a*, 154*b*. The corrugated paperboard material forming the first blank $B_1$' includes internal flutes 172, illustrated herein extending in an exemplary direction parallel to the longitudinal direction $L_2$, wherein flutes 172 in at least one of the corner piece halves 154*a*, 154*b* extend in a vertical direction when the bottom flange 130 is pivoted perpendicular to the first side wall 120 on the constructed container 108, as is described further below.

It may be understood that the corner pieces 154 described with reference to FIG. 8 are formed from a portion of the vertical side flanges 134, 136, wherein the longitudinal edges 164, 166 of the vertical side flanges 134, 136 extending along the flange cuts 138 are displaced longitudinally outward, i.e., toward the longitudinal center of the vertical side flanges 134, 136, from longitudinal alignment with respective adjacent longitudinal edges 112, 114 of the bottom wall 110. Further, the longitudinal edges 160, 162 of the bottom flanges 130, 132 are generally aligned with the respective longitudinal edges 112, 114 of the bottom wall 110.

Referring to FIG. 9, in the construction of the container 108, pivoting of the vertical side flanges 134, 136 toward the position perpendicular to the first side walls 120, 122, and pivoting of the bottom flanges 130, 132 into overlapping relationship to the vertical side flanges 134, 136, pivots the corner piece halves 154*a*, 154*b* about the fold line 168 into an overlapping relationship to each other, as is illustrated in the cut-away portion in FIG. 9. It may be understood that the flutes 172 in the corner piece halves 154*a* have a direction of elongation extending in a vertical orientation contiguous with vertically extending flutes in the respective vertical side flanges 134, 136. The bottom flanges 130, 132 may be secured, e.g., secured with adhesive, to the vertical side flanges 134, 136 to provide a configuration of the container 108 for receiving a product therein, wherein the lower edges of the vertical side flanges 134, 136, defined by the longitudinal edges 164, 166, are spaced from the bottom wall 110. It may be understood that in the secured position of the bottom flanges 130, 132, the corner piece halves 154*a*, 154*b* form leak resistant connecting portions extending between the longitudinal edges 160, 162 of the bottom flanges 130, 132 and the respective longitudinal edges 164, 166 of the vertical side flanges 134, 136 at the lower corners of the container 108.

Figure 11:
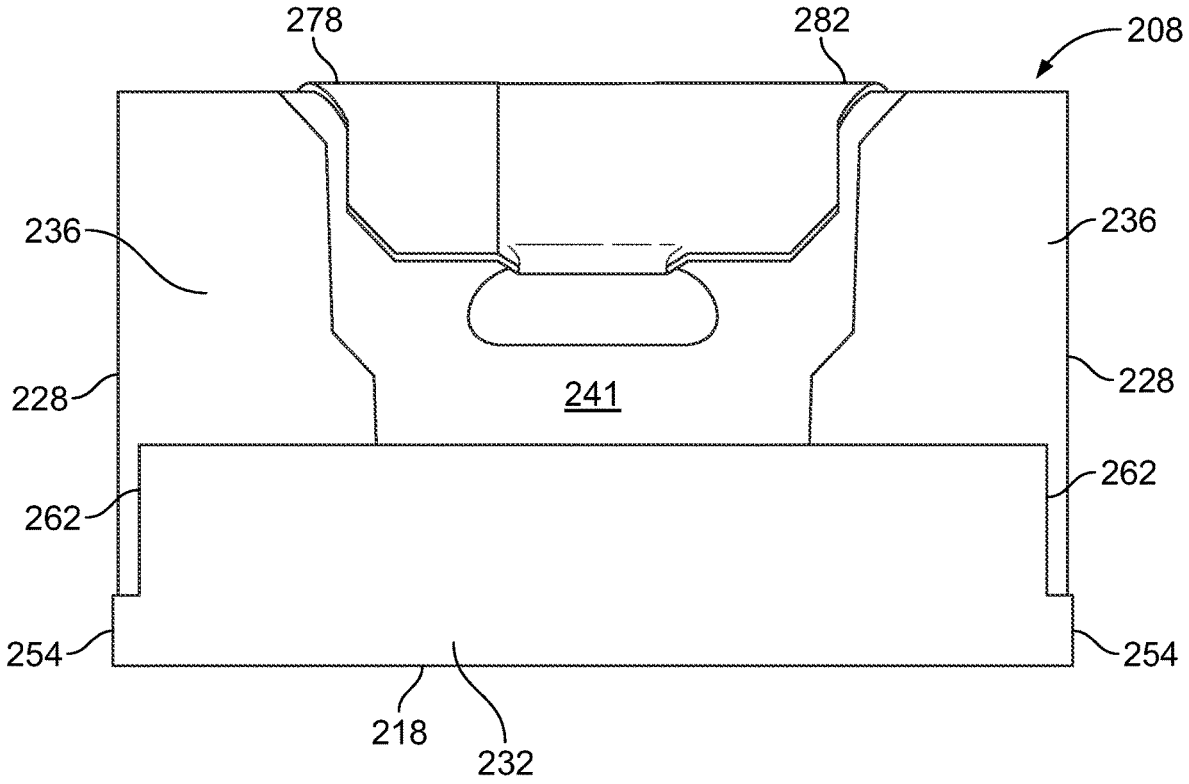
FIG. 11 is an end view of a bliss-type container constructed using the main body wrapper of FIG. 10.
Figure 10:
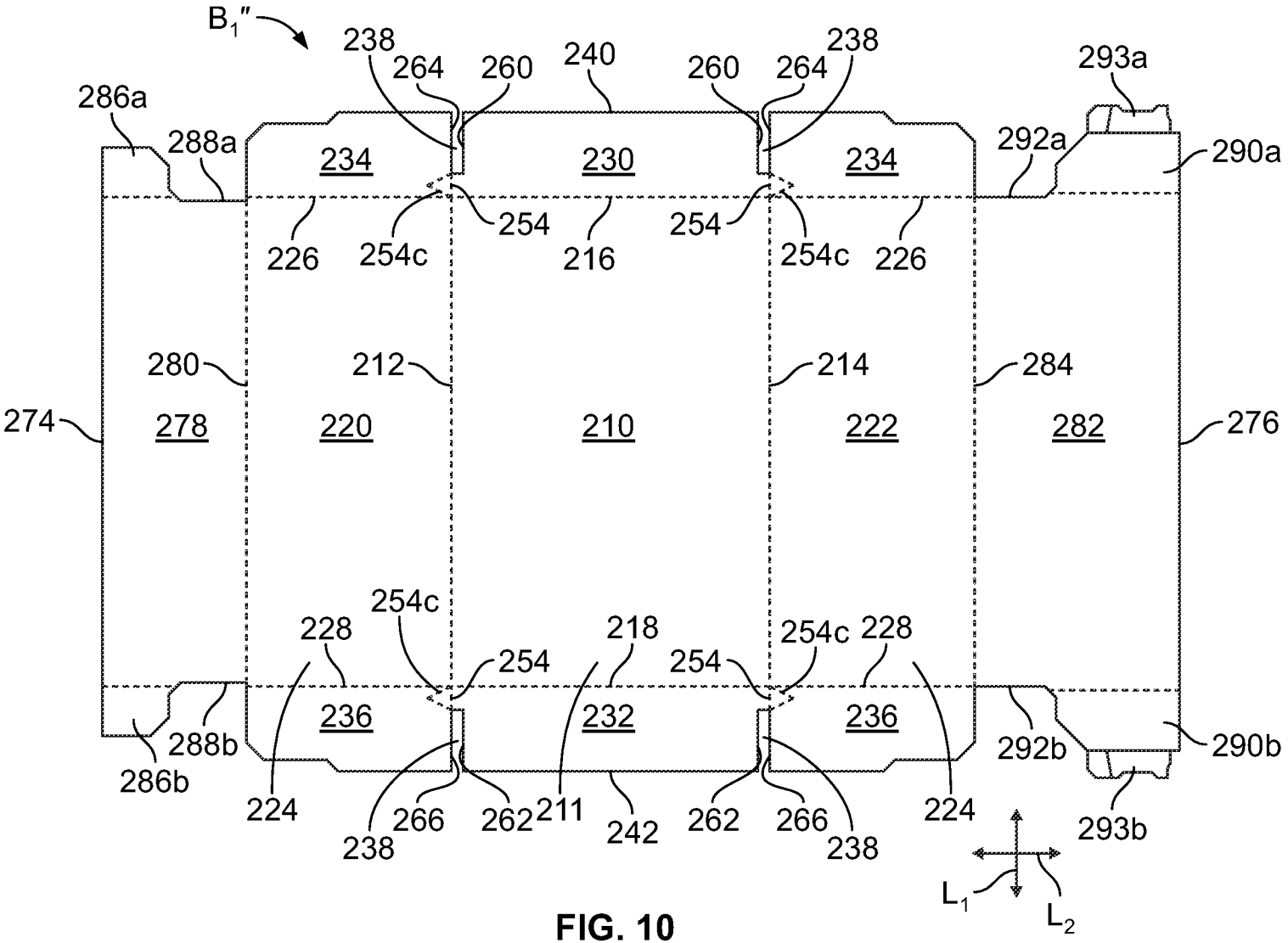
FIG. 10 is a plan view of a blank comprising a main body wrapper for the bliss-type container and illustrating a third configuration of a corner piece for forming a leak resistant corner.

Referring to FIGS. 10-11, an alternative configuration of the bliss-type container is described wherein elements corresponding to similar elements in the configuration of FIGS. 1-6 are identified with the same reference numeral increased by 200. In the container 208 of FIGS. 10-11, a variation of the main wrapper blank $B_1$" is described, wherein second and third end pieces for the bliss-type container 208 can be identical to the end blanks $B_2$, $B_3$ described above with reference to FIG. 3, or could comprise any other bliss end construction.

Referring to FIG. 10, the first blank $B_1$" may be formed of a corrugated cardboard material and may be die cut to the shape shown herein, although other materials and variations of the illustrated shape may be provided within the scope of the bliss-type container described and claimed herein. The blank $B_1$" illustrated in FIG. 10 is a planar piece of material in which an inner side 211 is shown facing out of the page. The blank $B_1$" extends in a lateral direction $L_1$ between first and second lateral edges, generally designated 240 and 242, respectively, and further extends in a longitudinal direction $L_2$ between first and second longitudinal edges, generally designated 274 and 276, respectively.

The first blank $B_1$" comprises a central bottom wall 210 having opposing longitudinal edges 212, 214 and opposing lateral edges 216, 218. A pair of first side walls 220, 222 are hingedly connected to the bottom wall 210 along respective fold lines defined at the longitudinal edges 212, 214, and each first side wall 220, 222 includes an inner surface 224 and opposing lateral edges 226, 228. Bottom flanges 230, 232 are hingedly connected to the bottom wall 210 along respective fold lines defined at the opposing lateral edges 216, 218 of the bottom wall 210.

A pair of vertical side flanges 234 and 236 are hingedly connected to each of the side walls 220, 222 along fold lines defined at the lateral edges 226 and 228, respectively, of the first side walls 220, 222. The vertical side flanges 234 are located on either side of the bottom flange 230 and are separated from the bottom flange 230 by a flange cut 238 defined between adjacent longitudinal edges 260, 264 of the bottom flange 230 and vertical side flange 234, respectively, wherein the flange cut 238 extends laterally from the lateral edge 240 of the blank $B_1$" toward the lateral edge 216 of the bottom wall 210. The vertical side flanges 236 are located on either side of the bottom flange 232 and are separated from the bottom flange 232 by a flange cut 238 defined between adjacent longitudinal edges 262, 266 of the bottom flange 232 and vertical side flange 236, respectively, wherein the flange cut 238 extends laterally from the lateral edge 242 of the blank $B_1$" toward the lateral edge 218 of the bottom wall 210. The bottom flange 230 and the vertical side flanges 234 are configured to overlap and be secured together, and the bottom flange 232 and the vertical side flanges 236 are configured to overlap and be secured together, as is described further below for the container construction.

A first top wall panel 278 is hingedly attached to the first side wall 220 along a fold line defined at an outer longitudinal edge 280 of the first side wall 220, and defines the first longitudinal edge 274. A second top wall panel 282 is hingedly attached to the other first side wall 222 along a fold line defined at an outer longitudinal edge 284 of the first side wall 222, and defines the second longitudinal edge 276. A first pair of closure flaps 286*a*, 286*b* are hingedly attached to opposing lateral edges 288*a*, 288*b* of the first top wall panel 278. A second pair of closure flaps 290*a*, 290*b* are hingedly attached to opposing lateral edges 292*a*, 292*b* of the second top wall panel 278, and include respective distal fold lock portions 293*a*, 293*b*.

A corner piece 254 extends laterally into the flange cut 238 from a location adjacent to the bottom wall lateral edges 216, 218 toward the respective lateral edges 240, 242 of the first blank $B_1$". The corner pieces 254 each comprise a rectangular web of material extending between the longitudinal edges 260, 262 of the bottom flange 230, 232 and the adjacent longitudinal edges 264, 266 of the vertical side flanges 234, 236 and defines a terminal end of the flange cuts 238 at an outer edge of the corner pieces 254, spaced laterally from the lateral edges 216, 218 of the bottom wall 210. In addition, crush areas 254*c* can be defined in the vertical side flanges 234, 236, adjacent to the corner pieces 254.

It may be understood that the corner pieces 254 are formed from a portion of the bottom flanges 230, 232, wherein the longitudinal edges 260, 262 of the bottom flanges 230, 232 extending along the flange cuts 238 are displaced longitudinally inwardly, i.e., toward the longitudinal center of the bottom flanges 230, 232, from longitudinal alignment with respective adjacent longitudinal edges 212, 214 of the bottom wall 210. Further, the longitudinal edges 264, 266 of the vertical side flanges 234, 236 are generally aligned with the respective longitudinal edges 212, 214 of the bottom wall 210.

In the construction of the container 208, pivoting of the vertical side flanges 234, 236 toward the position perpendicular to the first side walls 220, 222, and pivoting of the bottom flanges 230, 232 into overlapping relationship to the vertical side flanges 234, 236, as illustrated in FIG. 11, can result in the corner pieces 254 and crush areas 254*c* crushing while maintaining a connection between the bottom flanges 230, 232 and the lower edges of the vertical side flanges 234, 236 to form a leak resistant barrier to passage of fluid. The bottom flanges 230, 232 may be secured, e.g., secured with adhesive, to the vertical side flanges 234, 236 to provide a configuration of the container 208 for receiving a product therein. By forming the leak resistant corner pieces 254 from a portion of the bottom flanges 230, 232, the vertical side flanges 234, 236 remain unaltered and can extend from supporting engagement against the bottom wall 210 to the upper edges of the container 208.

It should be understood that although the corner pieces 254 and crush areas 254*c* described with reference to FIGS. 10 and 11 are described as being crushed, such crushing is not required to perform the function of resisting leakage in accordance with the present description. Hence, folding or other movements of the corner pieces in any of the configurations described herein may be performed to complete formation of the ends of the container while providing leak resistant corners.

As can be seen from the present description, a container 8, 108, 208 can be provided including a bliss-type construction that can limit or prevent leakage from the container and, in particular, a leak resistant corner construction can be provided that limits or prevents passage of fluid at the lower corners of the container and that can maintain compression strength in the vertical walls of the container for resisting deformation of the container walls when containers are stacked on top of each other. Additionally, the present container construction can provide several points for blocking leakage of fluid out of the container including, for example, a joint between the end wall and the adjacent inner surfaces of the vertical side flanges, a joint between the bottom flanges and the adjacent outer surfaces of the vertical side flanges, and the corner pieces described herein forming leak resistant corners.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A leak resistant bliss-type container comprising:

a first blank defining a bottom wall, opposed first side walls hingedly connected to longitudinal edges of the bottom wall and extending upwardly from the bottom wall, a vertical side flange hingedly connected to each of a pair of opposing lateral edges of the first side walls, and opposing bottom flanges hingedly connected to lateral edges of the bottom wall and extending upwardly in overlapping relation to the vertical side flanges;

second and third identical end blanks, each end blank defining at least an end wall such that corresponding ones of the vertical side flanges are positioned between the end wall and the corresponding bottom flange;

corner pieces each defined by a web of material, each corner piece extending between a longitudinal edge of one of the vertical side flanges and a longitudinal edge of the bottom flange to define a leak resistant corner;

wherein each vertical side flange is separated from an adjacent bottom flange on the first blank by a flange cut extending from a lateral edge of the first blank toward a respective lateral edge of the bottom wall; and wherein hinge connections for the opposed first side walls are defined on the first blank by respective longitudinal fold lines, and the longitudinal edges of the bottom flanges are displaced longitudinally inwardly from respective adjacent longitudinal fold lines and respective longitudinal edges of the vertical side flanges by a distance substantially equal to a longitudinal dimension of a corresponding one of the corner pieces.

2. The container as set forth in claim 1, wherein the web of material defining each corner piece extends laterally from a lateral edge of the bottom wall to a terminal end of the flange cut spaced from the lateral edge of the bottom wall.

3. The container as set forth in claim 2, wherein a lateral dimension of each corner piece, extending on the first blank from a lateral edge of the bottom wall to the terminal end of the flange cut, is generally equal to a dimension extending across the flange cut between the longitudinal edges of a bottom flange and a longitudinal edge of an adjacent vertical side flange.

4. The container as set forth in claim 3, wherein the container includes a fold line extending diagonally across each corner piece to define first and second generally triangular corner piece halves, the first blank being formed of a corrugated paperboard material having internal flutes, wherein flutes in at least one of the corner piece halves extend in a vertical direction.

5. The container as set forth in claim 1, wherein the longitudinal edges of the vertical side flanges are generally aligned with the respective longitudinal fold lines.

6. The container as set forth in claim 1, wherein the first blank comprises corrugated cardboard and flutes in the corner pieces and in the vertical side flanges extend vertically, and the vertical side flanges extend from the bottom wall to upper edges of the first side walls.

7. The container as set forth in claim 1, wherein the first blank comprises corrugated cardboard and flutes in the corner pieces and in the vertical side flanges extend vertically, and the vertical side flanges extend from a location spaced above the bottom wall to upper edges of the first side walls.

8. The container as set forth in claim 1, wherein each end blank includes a pair of intermediate walls hingedly connected to opposing longitudinal edges of the end wall and partial side walls hingedly connected to the intermediate walls and secured to respective inner surfaces of the first side walls.

9. The container as set forth in claim 1, wherein each bottom flange is secured to outer surfaces of an adjacent pair of the vertical side flanges.

10. A leak resistant bliss-type container comprising:

a first blank defining a bottom wall, opposed first side walls hingedly connected to longitudinal edges of the bottom wall and extending upwardly from the bottom wall, a vertical side flange hingedly connected to each of a pair of opposing lateral edges of the first side walls, and opposing bottom flanges hingedly connected to lateral edges of the bottom wall such that an upward pivoting of each bottom flange causes the bottom flange to overlap outer surfaces of an adjacent pair of the vertical side flanges;

second and third identical end blanks, each end blank defining at least an end wall secured in overlapping relation to the vertical side flanges; and corner pieces each defined by a folded web of material pinched between one of the bottom flanges and an adjacent one of the vertical side flanges to define a leak resistant corner;

wherein each vertical side flange is separated from an adjacent one of the bottom flanges on the first blank by a flange cut extending from a lateral edge of the first blank toward a respective lateral edge of the bottom wall;

wherein hinge connections for the opposed first side walls are defined on the first blank by respective longitudinal fold lines, and the longitudinal edges of the bottom flanges are displaced longitudinally inwardly from respective adjacent longitudinal fold lines and respective longitudinal edges of the vertical side flanges by a distance substantially equal to a longitudinal dimension of a corresponding one of the corner pieces.

11. The container as set forth in claim 10, wherein each corner piece is integrally formed with the one bottom flange and the adjacent one vertical side flange.

12. The container as set forth in claim 11, wherein each corner piece is formed of longitudinal end portions of the one bottom flange and comprises triangular halves pivoted into overlapping relationship.

13. A blank construction for a leak resistant bliss-type container comprising:

first, second, and third blanks securable together;

the first blank comprising:

a central bottom wall having opposing longitudinal edges and opposing lateral edges;

a first side wall hingedly connected to each of the longitudinal edges of the bottom wall at a respective longitudinal fold line, each first side wall including an inner surface and opposing lateral edges;

a bottom flange hingedly connected to each of the opposing lateral edges of the bottom wall at respective bottom flange fold lines; and a vertical side flange hingedly connected to each lateral edge of the first side walls at respective side flange fold lines for overlapping relationship with an adjacent bottom flange, each vertical side flange separated from the adjacent bottom flange by a flange cut extending laterally from a lateral edge of the first blank and each vertical side flange being securable to a respective adjacent bottom flange;

each of the second and third blanks comprising:

an end wall having opposing longitudinal edges; and partial side walls hingedly connected to the end wall, and each partial side wall securable to the inner surfaces of the first side walls; and a corner piece extending laterally into each flange cut, each corner piece extending from a location adjacent to a bottom wall lateral edge toward a respective lateral edge of the first blank to define leak resistant corners when the bottom flanges and vertical side flanges are pivoted into overlapping relationship;

wherein each of pairs of the vertical side flanges are positionable between an adjacent one of the end walls and an adjacent one of the bottom flanges, each of the bottom flanges has a longitudinal dimension sufficient to allow the bottom flange to overlap with the corresponding pair of vertical side flanges when the corresponding pair of vertical side flanges is positioned between the adjacent end wall and the bottom flange and each of the bottom flanges further has a lateral dimension less than a longitudinal dimension of each of the pair of vertical side flanges;

wherein hinge connections for the first side walls are defined on the first blank by a respective one of the longitudinal fold lines, and longitudinal edges of the bottom flanges are displaced longitudinally inwardly from respective adjacent longitudinal fold lines and respective longitudinal edges of the vertical side flanges by a distance substantially equal to a longitudinal dimension of a corresponding one of the corner pieces.

14. The construction as set forth in claim 13, further including an intermediate wall hingedly connected between each of the partial side walls and one of the longitudinal edges of the end wall.

15. The construction as set forth in claim 13, wherein each corner piece comprises a rectangular web of material extending between a longitudinal edge of a bottom flange and a longitudinal edge of an adjacent vertical side flange.

16. The construction as set forth in claim 15, wherein the web of material is foldable about a diagonal fold line and is pinched between a bottom flange and an adjacent vertical side flange to define a leak resistant corner when the bottom flange is pivoted into overlapping relationship over the adjacent vertical side flange.

17. The construction of claim 13, wherein the lateral dimension of each of the bottom flanges is at least one third of the longitudinal dimension of each of the pair of vertical side flanges.

* * * * *